United States Patent [19]

Kubis et al.

[11] Patent Number: 4,616,603

[45] Date of Patent: Oct. 14, 1986

[54] CYLINDER LINER FOR A MULTI-CYLINDER INTERNAL COMBUSTION ENGINE AND AN ENGINE BLOCK THEREFOR

[75] Inventors: Heribert Kubis, Nürenberg; Josef Winter, Rednitzhembach, both of Fed. Rep. of Germany

[73] Assignee: M.A.N. Nutzfahrzeuge GmbH, Munich, Fed. Rep. of Germany

[21] Appl. No.: 701,789

[22] Filed: Feb. 13, 1985

Related U.S. Application Data

[63] Continuation-in-part of Ser. No. 530,217, Sep. 8, 1983, abandoned.

[30] Foreign Application Priority Data

Sep. 10, 1982 [DE] Fed. Rep. of Germany ..... 3233578

[51] Int. Cl.[4] ..... F02F 1/16

[52] U.S. Cl. ..... 123/41.84; 123/193 C; 92/171

[58] Field of Search ..... 123/41.83, 41.84, 193 C, 123/193 CH, 668, 669; 92/171

[56] References Cited

U.S. PATENT DOCUMENTS

| | | | |
|---|---|---|---|
| 2,783,748 | 3/1957 | Brenneke | 123/41.83 |
| 3,046,952 | 7/1962 | Dolza | 123/41.83 |
| 4,385,595 | 5/1983 | Shaw | 123/193 C |

FOREIGN PATENT DOCUMENTS

| | | | |
|---|---|---|---|
| 2035452 | 6/1980 | United Kingdom | 123/41.84 |

*Primary Examiner*—William A. Cuchlinski, Jr.
*Attorney, Agent, or Firm*—Felfe & Lynch

[57] ABSTRACT

A multi-cylinder internal combustion engine has flangeless wet cylinder liners to reduce the size of the engine. Each cylinder liner has a shoulder near its crankcase end for sealing a coolant space around the liner and for compression against a seat of an engine block with an individual cylinder head at its opposite, flangeless cylinder head end. Near the cylinder head ends, the liners have side sealing lands cooperative with sealing lands on a web of the engine block without affixation thereto for sealing the adjacent end of the coolant space, the web being thin because it does not support the cylinder head to reduce further the engine size.

4 Claims, 6 Drawing Figures

CYLINDER LINER FOR A MULTI-CYLINDER INTERNAL COMBUSTION ENGINE AND AN ENGINE BLOCK THEREFOR

This is a continuation-in-part of U.S. patent application Ser. No. 530,217 filed Sept. 8, 1983 and abandoned herewith.

This invention relates to a cylinder liner for a multi-cylinder internal combustion engine and an engine block therefor.

The replaceable cylinder liners of most internal combustion engines currently built with so called "wet" or coolant-contacted liners have a flange at their usually upper, cylinder head end with which they rest on the engine block. The flanges are clamped to the engine block with at least part of the force holding the cylinder head on the engine block. This configuration has one drawback in that the outside diameter of the flange is necessarily larger than the cylinder bore so that a relatively large cylinder spacing is necessary to accommodate such liners in the engine block. The large cylinder spacing is also necessitated because the necessarily high clamping pressure of the cylinder head on the liner flange has to be taken up by stiffening walls all round and thus between the individual cylinders. A substantial disadvantage of this configuration therefore is that a relatively large cylinder spacing results and, consequently, an undesirably large physical size (cubic space) is taken up by the engine.

One possibility for reducing the cylinder spacing and thereby the physical size of the engine is the use of cylinder tubes cast in the engine block, possibly in combination with dry liners inserted in the tubes, these liners being also formed with a flange in the upper region. This configuration, however, suffers from a drawback, especially in the case of larger engines, in that the cast-in tubes make the engine block casting considerably more complicated. For instance, in contrast with a design having "wet" liners, a separate coolant (water) jacket sand core is necessary for making the casting. Supporting this core in the mold and removing the core sand call for undesirably large, weakening openings in the important stress-bearing walls of the engine block. Especially for engines designed for small physical size, it is furthermore inevitable that the coolant jacket sand core is thin over large areas. The thin core considerably enhances the risk of flaws resulting in rejection of the casting. Still furthermore, there is also the danger of cracks in the core forming ribs in the casting which interrupt the convection flow of the coolant to important surfaces. This, in high-performance engines, would inevitably result in engine breakdown. In order to be sure such ribs (or fins) are avoided, it is necessary that the coolant space should be accessible for inspection at all points. However, the many openings in the stress-bearing walls of the engine block which this requires makes it infeasible, so that the risk of latent defects automatically increases in engines of this construction.

Another possibility for reducing the cylinder spacing and thereby the physical size of the engine is disclosed in Japanese Patent Publication No. 41,434. It is to seat wet cylinder liners at their usually lower end at the crankcase and to separate the individual liners only with a web at the opposite, usually upper, cylinder head end of the liners. It is intended, in this manner, not only to increase the capacity of the cooling water passages formed between the liners in the engine block but also, and particularly, to stiffen the engine block and crankcase by affixing the liners to the individual webs and the crankcase slot, specifically, with solder. Thus, as in the case of cylinder tubes cast in the engine block, the liners are part of the cylinder block and share in the transfer of tension and compression forces. Such a design has the disadvantage that resilient deformation of the entire length of the liner cannot take place; the affixation at the cylinder head, web end and the crankcase seat supporting the liner prevents overall resilient deformation of the liner. On account of the resulting distortions of the liner, reliable sealing by the cylinder head gasket is not assured. Furthermore, with the affixation, there is no possibility of easily replacing the cylinder liner if repairs are needed.

Multi-cylinder internal combustion engines with wet liners seated at their usually lower, crankcase ends were also disclosed in *Automotive Engineering,* October 1980, pages 125 and 126. In the block of these engines, however, the coolant spaces at the cylinder head end of the liners is open. Sealing of the coolant spaces towards the cylinders is supposed to be effected between the cylinder head or heads and the end faces of the liners and, in the other direction, between the cylinder head and engine block. This dual sealing function of the cylinder head is unreliable. Further, even with multiple cylinder heads, each covers several cylinders.

Therefore, it is an object of the present invention to reduce the physical size (cubic space) of a multi-cylinder internal combustion engine without the penalties of more complicated production or unreliablity.

This and other objects are achieved with a cylinder liner for each cylinder of multi-cylinder internal combustion engine. Each liner has an outside shoulder near one end, and a sealing land generally parallel to the cylinder therein on the outside near the opposite end which is flangeless. The shoulder seats at the usually-lower, crankcase end of an engine block, preferably sealingly to define a coolant space thereabove and surrounding the thereby wet liner. The sealing land on the liner then sealingly cooperates with a sealing land on the opposite, cylinder head end of the engine block without affixation thereto. Between the individual liners, the engine-block sealing land is preferably formed on a mere web.

Sealing the coolant space at the sealing lands (and shoulder/seat) without affixation therebetween is preferably assured with at least one O-ring therebetween. The O-rings may be held in grooves. The O-ring seal in the area of the shoulder seat also protects the shoulder and seat against corrosion by the coolant and seals in the crankcase oil.

The cylinder liner has a slight but sufficient superelevation above the cylinder head bearing surface of the engine block when seated therein for compression sealing toward the shoulder by the cylinder head. By having the shoulder of the liner at the opposite, crankcase end, the pressure of the cylinder head first acts on the opposite, crankcase end of the block, causing the entire length of the sleeve to be compressed resiliently until it is flush with the cylinder head bearing surface. In comparison to liners having a flange or other affixation on the top, cylinder head end, this results in (a) a greater expansion length which results in less loss of cylinder-head bolt loading due to unavoidable settling and (b) allowing the liner to follow resiliently the lifting movement of the cylinder head at the moment of ignition, thereby reducing the "breathing" of the head seal and improving the combustion chamber sealing even under the very high firing pressures commonly encountered in modern supercharged engines.

The web preferably providing the engines block sealing land between the individual cylinders is exposed to virtually none of the holding-down force exerted by the cylinder head and, thus, in conjunction with the preferred O-ring, serves only to seal the cooling water space about the cylinder circumference at the head end. Forces are transmitted only by the crankcase-end shoulder to the seat surrounding the cylinder liners, the forces being introduced via the threads of the cylinder head bolts. A result is that the webs can be thin and, thus, the cylinders close together for small engine size. A further result is a reliable cylinder head gasket seal without web bump inteference.

Furthermore, individual cylinder heads may be used. These, on account of the independent association of one cylinder head with each liner and a cylinder head gasket, provide optimum conditions. Also, any leakage of water through the gap between the individual cylinder heads is realiably prevented by the sealing land and O-ring cylinder liner sealing. The individual heads also provide a number of additional advantages, for example: easier installation, easier repair, less risk of distortion, use of the same head on engines of different types and numbers of cylinders, etc.

As an especially advantageous further development, it is proposed that the cylinder head bolt tappings be disposed below the seat for the cylinder liner shoulder, i.e. closer to the crankcase and farther from the cylinder head than the shoulder/seat. If this is done, the high tension forces present in the walls of the engine block from the liner shoulder seat to the bolt tappings in the case of cylinder head bolt taps disposed at the top, cylinder head end of the block are converted to compression forces, making it possible to clamp the liner perfectly throughout long periods of operation, even in the case of materials of low tensile strength. Furthermore, since the forces are introduced below the liner seat, the web is entirely relieved of the slight distortions which are unavoidable in the case of cylinder head bolt tappings situated at the top, cylinder head end of the block and this is advantageous, especially in the case of very thin webs. High tensions and resultant cracks in the web would, in the long run, result in engine breakdown.

The invention achieves more than the desired reduction in physical size (cubic space) by eliminating the flange about the top of the liner. In addition, and in contrast to the art cited in respect to engines having bottom-seated liners, it can be used with individual cylinder heads which have a number of advantages, for example easier installation, easier repair, less risk of distortion, and use of the same head for engines of different numbers of cylinders and constructions, because the side sealing land of the liner prevents coolant leakage through the gap which always exists between individual cylinder heads.

By seating the liner near its crankcase end and avoiding affixation at the other end, at least a portion of the force holding on the cylinder head clamps substantially the complete length of the liner onto the seat for the shoulder of the liner. Compared with liners having a flange or other affixation at the cylinder head end, this results in a longer elastic clamped length which, in turn, results in less loss of initial bolt loading due to inevitable settling and, consequently, a better gas seal to the cylinder head. Furthermore, there is no need to have thick-walled stiffening members in the cylinder because the holding-down force of the cylinder head (caused by the usual slight amount of projection of the liner above the cylinder head end of the engine block) only acts on the crankcase level of the engine block.

The sealing land provided in the engine block according to the invention between the individual cylinders is not subject to substantial holding-down forces exerted by the cylinder head, but serves only for sealing the coolant space at the cylinder head end of the engine block. It, therefore, is formed by the side of a thin web to reduce further cylinder spacing and thus engine size. The depth of the web is also limited since it is not force bearing. This allows coolant to flow between the cylinders to a sufficient level to provide effective cooling of the particularly hot sealing land area at the cylinder head end of the liner.

With a view to ensuring as effective cooling as possible at the cylinder head end of the liners where the coolant space between the cylinders is particularly constricted by bosses integrally cast in the engine block for receiving bolts for fastening on the cylinder head due to the shorter cylinder spacing achieved with the inventive liner, the invention also provides a coolant duct in the engine block therefor obliquely under each boss and extending from a coolant supply duct arranged laterally along the engine block toward the adjacent web. This ensures very intensive cooling of this region which is heated by the two adjacent cylinders at the hot, cylinder head end thereof.

As a still further feature of the invention, each liner is formed with a recess at a level directly opposite the sealing land from the cylinder head end of the liner. This recess serves for still better coolant communication with the areas of the coolant space confined by the integral bosses and, consequently, poorly vented with vent holes communicating with these areas. The vent holes ensure satisfactorily venting of the complete coolant space during filling when the engine is oriented cylinder head up.

Due to the higher rate of heating of the liner by the combustion gases as compared to the surrounding engine block (especially during cold starting) and the associated greater amount of thermal expansion of the liner, leakages are liable to occur at the various seals. Therefore, flexible elements, preferably O-rings, may be provided at these points in order to ensure satisfactory sealing in spite of the differing thermal expansion. At least one O-ring, which may be fitted in a groove in the liner or web, may assist in the seal at the sealing lands. Additional O-ring seals may be provided in the region of the seat in the engine block for the shoulder of the liner to protect the shoulder from corrosive attack by the coolant and to seal the crankcase oil space.

Further details of the invention can be dervied from the description given hereunder of merely illustrative preferred embodiments which are illustated in drawings in which.

Figure 1:
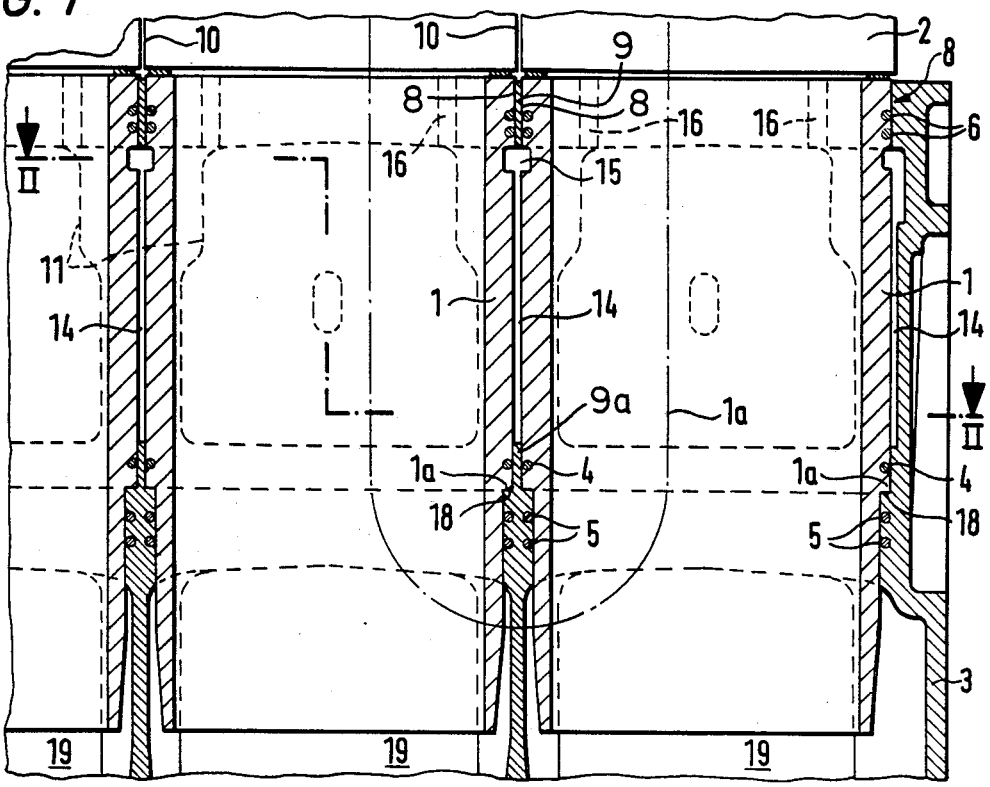
FIG. 1 is a sectional elevation of a side portion of one preferred embodiment of an engine block with correspondingly preferred cylinder liners.

In a usually-lower region near the crankcase end of replaceable wet liners 1 for the cylinders of a multi-cylinder internal combustion engine, each liner has a shoulder 1*a* with which it rests on a seat 18 at the crankcase end of an engine block 3. Each liner 1 projects slightly beyond the end of the engine block opposite the crankcase to an individual cylinder head 2 which is secured to the engine block to press the liner onto the seat 18 and thereby clamp it in the engine block 3.

Figure 3:
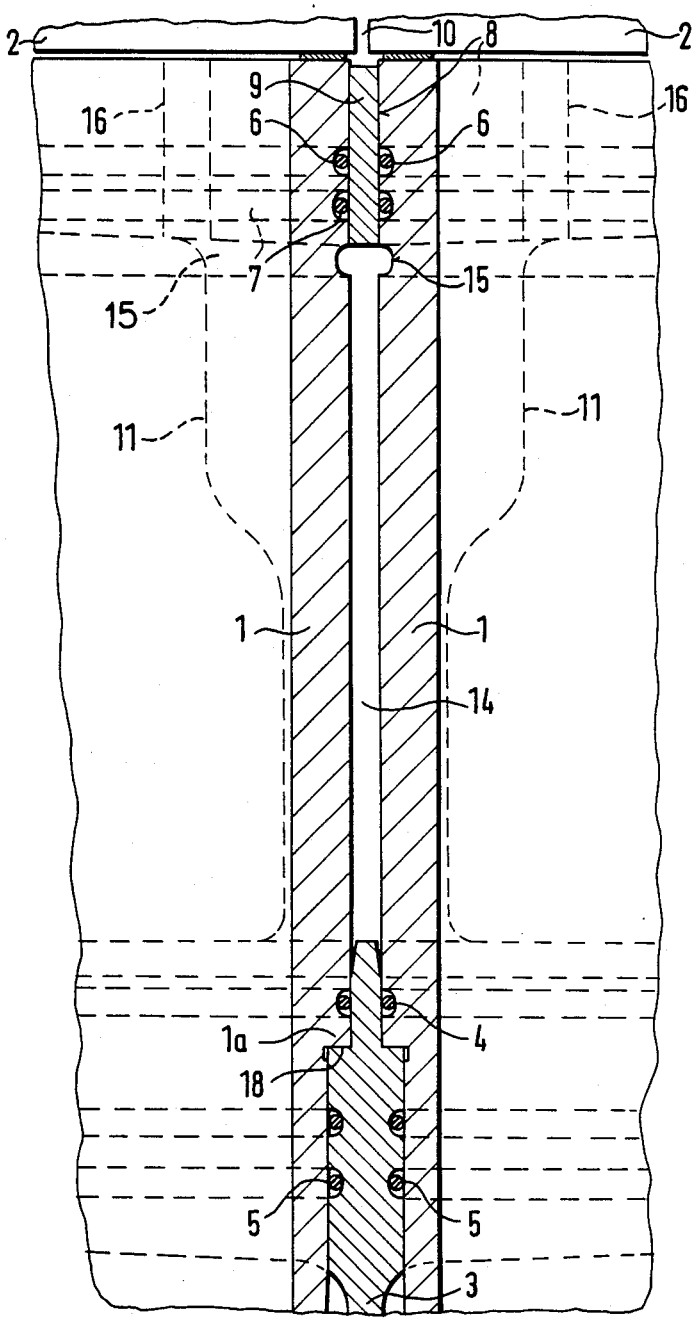
FIG. 3 is an enlarged portion of the embodiment shown in FIG. 1.

According to the invention, a coolant space 14 between and around each liner 1 is sealed at the cylinder head end of the liner with a machined cylindrical sealing land 8 on a side of the liner generally parallel to the cylinder therein and a corresponding sealing land on an adjacent portion of the engine block which, between liners, is formed on a thin web 9. In the embodiment illustrated, two O-rings 6 are provided between each liner 1 and web 9 at the sealing lands, the O-rings being fitted in grooves 7 (FIG. 3) of the individual liners 1. The width of the webs 9 of the engine block is selected to provide sufficient coolant space 14 since the webs are not load bearing. The sealing lands enable individual cylinder heads to be used because coolant leakage through the gap 10 between the cylinder heads 2 is positively prevented by the seal at the sealing lands.

Another O-ring seal 4 is provided between the liners and a projection 9*a* from each seat 18. In addition to mere sealing, it serves to protect the liner-contacting face of the seat from corrosive attack by the coolant. This O-ring seal may alternatively be arranged either in a groove of the liner 1 (FIG. 3) or a groove in the projection (not shown). Two further O-rings 5 are provided between the liners and the portion of the engine block providing seat 18 on the other side of the seat from the projection. These O-rings serve to seal the water space 14 against the oil in the crankcase space 19. The O-rings of adjacent liners may be at staggered levels (not shown) to obtain a minimum cylinder spacing.

Figure 2:
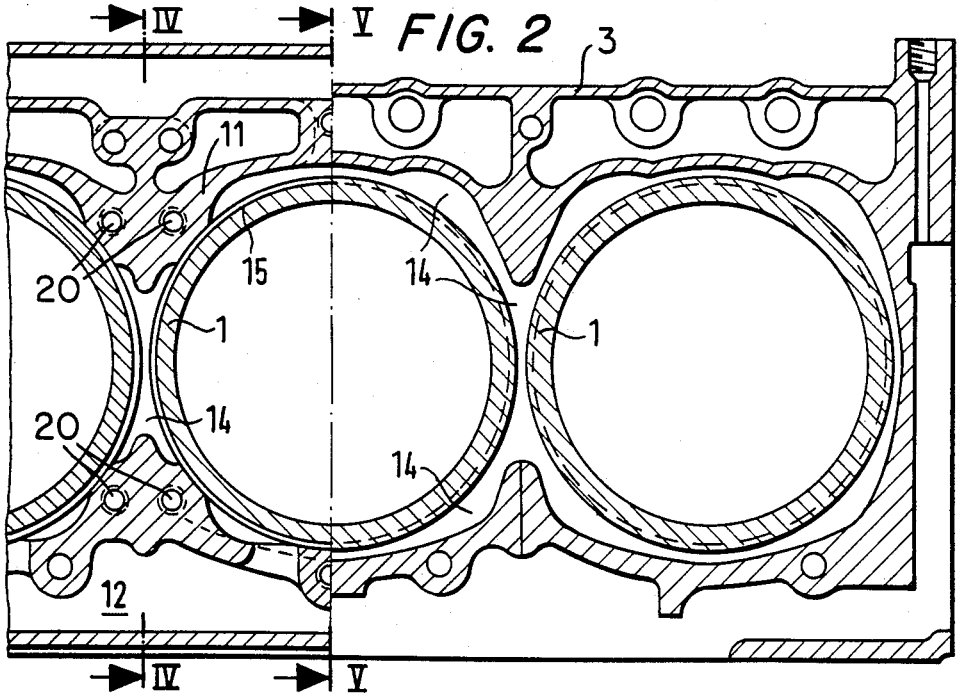
FIG. 2 is a sectional plan along the line II—II in FIG. 1.

The O-rings 4, 5, and 6 also accommodate different thermal expansion (horizontally) of the liners 1 and engine block 3, primarily during cold starting. Gas sealing of the liners 1 to the cylinder heads 2 is effected with conventional gaskets between the cylinder heads and the adjacent end face of the liners. With appropriate design of the cylinder head bolt connection to engine block tappings 20 (FIGS. 2, 4 and 5), this also accommodates different thermal expansion (vertically) of the liners and cylinder heads and engine block.

Figure 4:
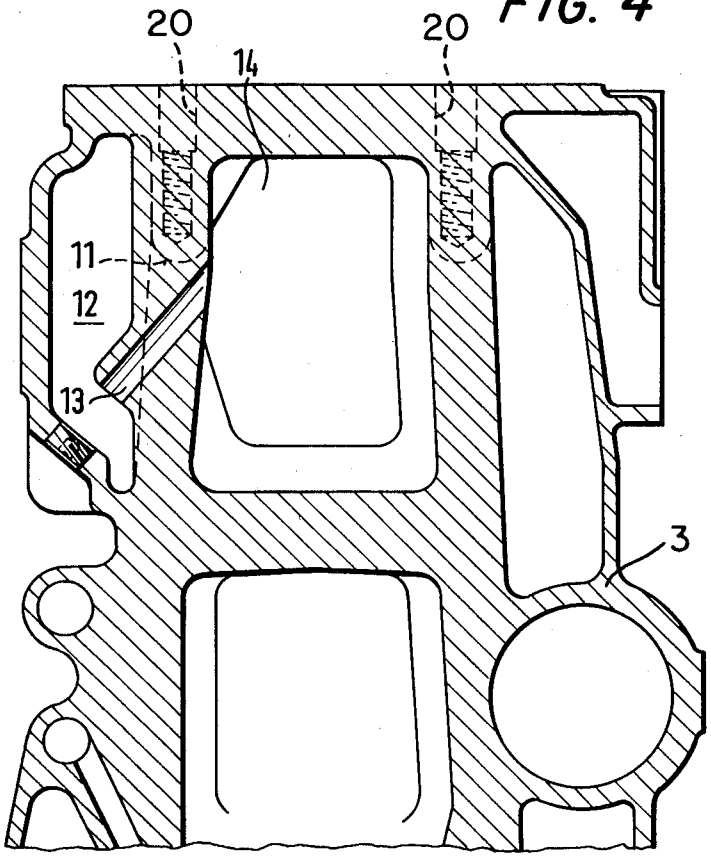
FIG. 4 is a sectional view along the line IV—IV in FIG. 2.

Further improvement of the cooling is achieved by improving the flow of coolant into the region of coolant space 14 at webs 9. As shown in FIG. 4, this is obtained by purposely directing additional coolant upwards from a coolant supply channel 12 in the engine block 3 via a channel 13 extending obliquely below bolt bosses 11 integrally cast in the engine block for the tappings 20 for bolts which secure the cylinder heads to the engine block. This ensures that the upper region of the coolant space 14 proximate the sealing land which is intensely heated and, as shown best in FIG. 2, narrowed by the bosses 11 is supplied with sufficient coolant.

In order to achieve positive venting and filling of the complete coolant space 14, each liner 1 is formed with a recess 15 at a level directly below the sealing lands 8. This recess 15 ensures an effective connection of the regions of the coolant space 14 constricted by the bolt bosses 11 with vent holes 16 (FIG. 3) also in the bosses.

Figure 5:
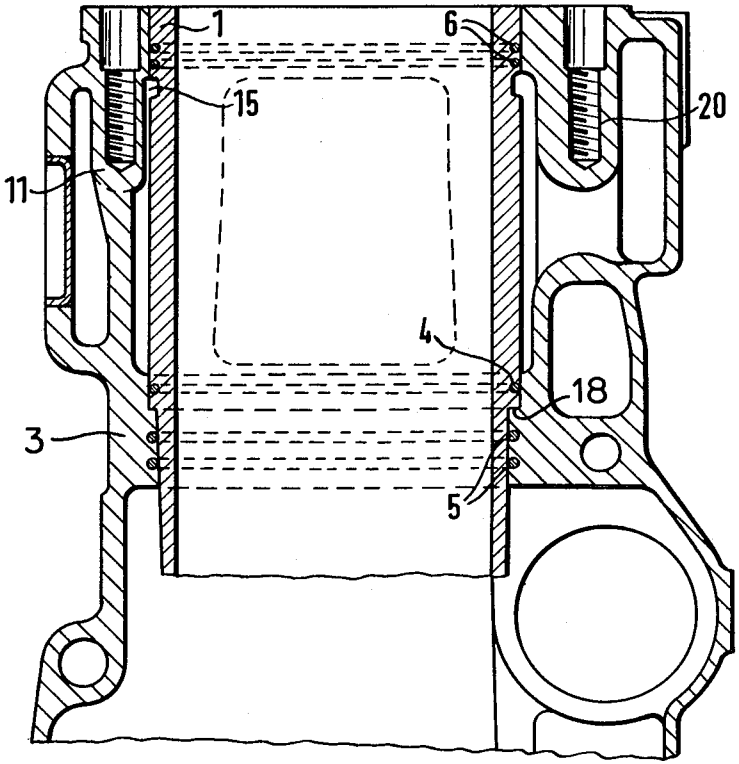
FIG. 5 is a sectional view along line V—V in FIG. 2.
Figure 6:
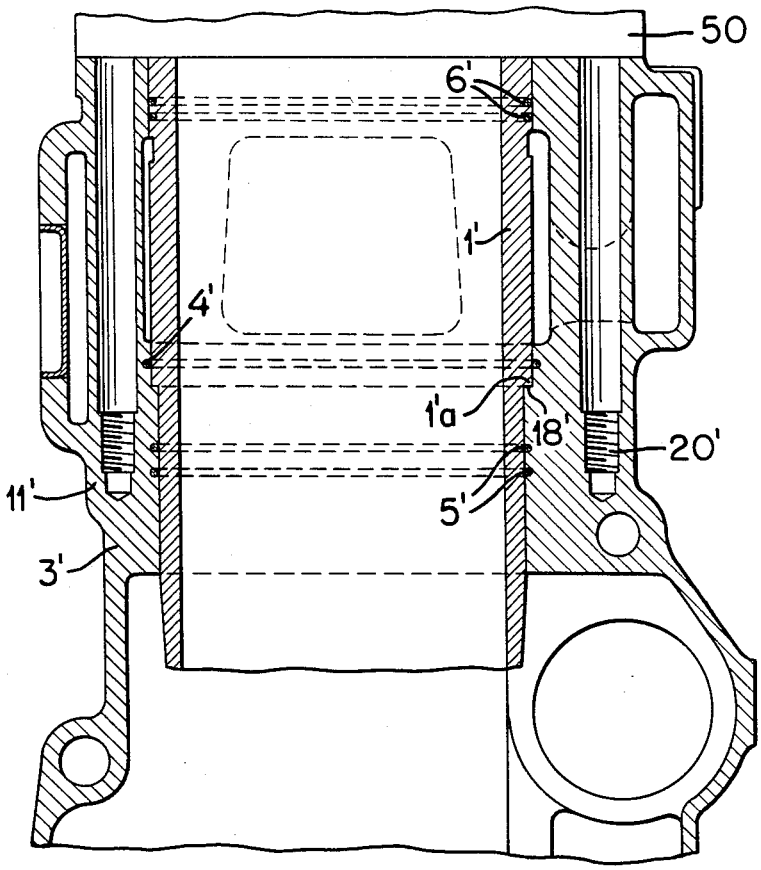
FIG. 6 is a section view similar to FIG. 5 but of another preferred embodiment.

In the other preferred embodiment of FIG. 6, the liner 1' is substantially the same as that previously described (cf. FIG. 5). The engine block 3', however, differs in that the bolt bosses 11' for the tappings 20' for the bolts (not shown) which are parallel to the cylinder liner and secure the cylinder head 50 over the cylinder are on the opposite, crankcase side of the seat 18' which the shoulder 1*a'* of the liner engages, i.e. farther from the cylinder head than the seat.

This provides a longer elastic clamping distance for the bolts for the advantages previously described for the liner. Further, tensile forces between the liner seat 18' and tapping 20' are avoided. These become compressive forces when the bolt tappings are below the seat to make possible the use of materials of low tensile strength but sufficient compressive strength. Still further, as particularly preferred and illustrated, the tappings 20' are closer to the seat 18' than when at the cylinder head end as in FIG. 5. Bringing the opposing forces on the tappings and seat closer in this way relieves stress on some of the engine block.

Concluding, it should be mentioned that the invention as described for the preferred embodiments also makes it possible to increase the piston-swept volume and thus the engine output for given external dimensions of the engine, because the webs 9 are thin, and a saving in weight is also achieved, due to the absence of thick-walled partitions conventionally provided between the individual cylinders.

It will be understood that the specification and examples are illustrative but not limitative of the present invention and that other embodiments within the spirit and scope of the invention will suggest themselves to those skilled in the art.

What is claimed is:

1. A process for making a multi-cylinder internal combustion engine having a wet cylinder liner with a cylinder therein for each cylinder of the engine and an individual cylinder head therefor, comprising:

providing each cylinder liner with an outside shoulder near one end for support from a seat in one, crankcase end of the engine;

providing a sealing land of the outside of each cylinder liner generally parallel to the cylinder therein and near the other end of the cylinder liner;

separating each two cylinder liners from each other with a web at the opposite, cylinder head end of the engine such that each cylinder liner has a slight superelevation therefrom sufficient for compression sealing by the individual cylinder head thereon toward the shoulder;

bolting each cylinder head to the engine for the compression sealing to the cylinder liner therefor;

sealing the sealing land of each two cylinder liners to the web therebetween without affixation for sealing a coolant spaced therebelow, toward the crankcase end of the engine and without any contact between the web and the cylinder heads thereat; and designing each cylinder liner at the end near the sealing land without any flange enlargement for the compression sealing by the cylinder head therefor to the shoulder.

2. The process of claim 1, wherein bolting each cylinder head to the engine comprises bolting the same with a bolt from the cylinder head therefor to threads parallel to the cylinder liner and farther from the cylinder head than the shoulder of the cylinder liner.

3. In a multi-cylinder internal combustion engine having a block and a wet cylinder liner for each cylinder, the improvements comprising:

an outside shoulder on each cylinder liner near one end for sealingly seating near the crankcase end of the engine block so as to define a coolant space about the thereby wet cylinder liner toward the opposite, cylinder head end of the engine;

a cylinder head for each cylinder liner;

means comprising an opposite, flangeless end on each cylinder liner for compression sealing by the cylinder head therefor toward the shoulder;

bolts bolting each cylinder head to the engine block for providing the compression for sealing each cylinder head to the cylinder liner therefor;

a web of the engine block across the coolant space at the flangeless end of the cylinder liner and having a sealing land said flangeless end of each cylinder liner being superelevated from the web relative to the shoulder; and a sealing land on the outside of each cylinder liner neat the flangeless end thereof and generally parallel to the cylinder therein for sealing without affixation to the sealing land on the web.

4. The engine of claim 3, wherein the bolts are parallel to each cylinder liner and thread into the engine block farther from the cylinder head than the shoulder.

* * * * *